US010575573B2

(12) United States Patent
Griffiths

(10) Patent No.: US 10,575,573 B2
(45) Date of Patent: Mar. 3, 2020

(54) REVERSIBLE UPPER-BODY SUPPORT GARMENT

(71) Applicant: Knix Wear Inc., Toronto (CA)

(72) Inventor: Joanna Griffiths, Toronto (CA)

(73) Assignee: Knix Wear Inc., Toronto (CA)

( * ) Notice: Subject to any disclaimer, the term of this patent is extended or adjusted under 35 U.S.C. 154(b) by 28 days.

(21) Appl. No.: 15/974,846

(22) Filed: May 9, 2018

(65) Prior Publication Data

US 2018/0325193 A1 Nov. 15, 2018

Related U.S. Application Data

(60) Provisional application No. 62/503,773, filed on May 9, 2017.

(51) Int. Cl.

| | |
|---|---|
| ***A41D 15/00*** | (2006.01) |
| ***A41C 3/14*** | (2006.01) |
| ***A41C 3/00*** | (2006.01) |
| *A41D 7/00* | (2006.01) |
| *A41D 1/22* | (2018.01) |

(Continued)

(52) U.S. Cl.

CPC ..... *A41D 15/005* (2013.01); *A41C 3/0014* (2013.01); *A41C 3/144* (2013.01); *A41C 3/08* (2013.01); *A41D 1/18* (2013.01); *A41D 1/22* (2013.01); *A41D 7/00* (2013.01)

(58) Field of Classification Search

CPC .... A41D 15/005; A41D 3/0014; A41D 3/144; A41D 3/0057; A41C 3/0057; A41C 3/0014; A41C 3/005

USPC ..... 450/37, 39, 54–57, 91; 2/67

See application file for complete search history.

(56) References Cited

U.S. PATENT DOCUMENTS 4,414,691 A * 11/1983 Estruch ..... A41D 15/005 2/400

5,180,326 A * 1/1993 Williams ..... A41C 3/148 2/73

(Continued)

FOREIGN PATENT DOCUMENTS

| | | |
|---|---|---|
| FR | 1059664 | 3/1954 |
| JP | S57-154704 | 9/1982 |
| WO | WO 2004086891 | 10/2004 |

OTHER PUBLICATIONS

Machine generated English translation of JP S57-154704, downloaded from Espacenet.com, Dec. 11, 2018.

(Continued)

*Primary Examiner* — Gloria M Hale

(74) *Attorney, Agent, or Firm* — Dascenzo Intellectual Property Law, P.C.

(57) ABSTRACT

Provided herein is a reversible upper-body support garment comprising a light-toned layer; a dark-toned layer; the layers overlying each other and dimensioned to together be stretched in a supporting fit around the upper body of a wearer with either the light-toned layer or the dark-toned layer facing outwards from the wearer; and at least one breast pad between the light-toned layer and the dark-toned layer, the at least one breast pad having a dark-toned surface that is adjacent to the light-toned layer thereby to face outwards from behind the light-toned layer when the light-toned layer is facing outwards from the wearer. In embodiments, the upper-body support garment is a bra.

14 Claims, 5 Drawing Sheets

(51) Int. Cl.
*A41C 3/08* (2006.01)
*A41D 1/18* (2006.01)

(56) References Cited

U.S. PATENT DOCUMENTS

| | | | | |
|---|---|---|---|---|
| 6,083,080 | A * | 7/2000 | Lawson | A41C 3/10 450/39 |
| 6,110,005 | A * | 8/2000 | Stephenson | A41C 3/10 450/39 |
| 6,168,498 | B1 * | 1/2001 | Wagner | A41C 3/0057 450/1 |
| 6,174,217 | B1 * | 1/2001 | Judson | A41C 3/0042 2/406 |
| 7,435,156 | B1 * | 10/2008 | Liu | A41C 3/0014 450/39 |
| 2001/0019933 | A1 * | 9/2001 | Wagner | A41C 3/0057 450/37 |
| 2006/0025039 | A1 * | 2/2006 | Barbour | A41C 3/0057 450/1 |
| 2010/0144241 | A1 * | 6/2010 | Dowe | A41C 3/0028 450/39 |
| 2013/0217304 | A1 * | 8/2013 | Bailey | A41C 3/0028 450/52 |
| 2014/0317823 | A1 * | 10/2014 | Hanson | A41D 15/005 2/69 |
| 2014/0364037 | A1 * | 12/2014 | Bailey | A41C 3/02 450/58 |
| 2015/0173425 | A1 | 6/2015 | Steinberg | |

OTHER PUBLICATIONS

European Patent Office, Extended European Search Report for related European Application No. 18171480, dated Sep. 27, 2018.

* cited by examiner

REVERSIBLE UPPER-BODY SUPPORT GARMENT

CROSS-REFERENCE TO RELATED APPLICATION

This application claims priority to U.S. Provisional Patent Application Ser. No. 62/503,773 filed on May 9, 2017 the contents of which are incorporated by reference herein.

FIELD OF INVENTION

The present invention relates generally to the field of garments, and more particularly to reversible upper-body support garments such as bras that incorporate supportive breast pads.

BACKGROUND OF INVENTION

Bras and other garments such as swimsuits that have an upper-body portion incorporating breast pads are well-known. The breast pads incorporated into such garments can serve various functions including providing support as well as enhancing the shape or size of the wearer's breasts, absorbing moisture, providing varying levels of coverage and/or comfort and the like. Examples of such garments are padded bras, padded exercise tops, dresses, and padded one-piece and bikini swimsuits.

Breast pads are known to be made using a variety of materials, and they may be incorporated into garments as removable elements or more permanently sewn or otherwise fixed to the body of the garment. For either construction, it would generally be aesthetically desirable for the overall garment to have as smooth and as uniform an appearance as would a similar garment not incorporating breast pads. In this way, the role of the breast pads in providing support, enhancements and/or moisture absorption would not be made immediately apparent to observers.

Padded bras and similar garments having a supportive upper-body portion tend to incorporate light nude or white coloured breast pads. However, when worn fitted closely to the wearer, such white and nude breast pads often result in an undesirable effect in which the breast pads appear in noticeable contrast with the rest of the garment. This contrast is especially apparent in reversible bras having the characteristic of one light tone on one side of the bra and a different, darker tone on the opposite side of the bra. In such cases, light nude and white breast pads will often contrast against the darker-toned side of the bra, highlighting or making visible the breast pad through the lighter-toned side of the bra when facing outwards from the wearer. This effect is sometimes referred to informally as the "headlight" effect and may even be visible to observers through an additional garment worn overtop, such as a blouse. The headlight effect due to the contrast, an example of which is shown in FIG. 1, makes it apparent to observers that there are breast pads in the breast garment.

SUMMARY OF INVENTION

In accordance with an aspect, there is provided a reversible upper-body support garment comprising a light-toned layer; a dark-toned layer; the layers overlying each other and dimensioned to together be stretched in a supporting fit around the upper body of a wearer with either the light-toned layer or the dark-toned layer facing outwards from the wearer; and at least one breast pad between the light-toned layer and the dark-toned layer, the at least one breast pad having a dark-toned surface that is adjacent to the light-toned layer thereby to face outwards from behind the light-toned layer when the light-toned layer is facing outwards from the wearer.

In an embodiment, the light-toned and dark-toned layers are mirror images of each other.

In an embodiment, the upper-body support garment is a bra.

The light-toned layer may be white, nude, or some other light-toned colour. The dark-toned layer may be black, dark nude, or some other dark-toned colour. Tone herein is intended to refer generally to qualities of brightness, deepness, or hue of a tint or shade of a colour, and their roles in defining visual contrasts and similarities. Other tones and contrasting combinations for the layers are possible. The dark-toned breast packs) may be matched in tone to the dark-toned layer. However, the dark-toned breast pad(s) may be different in tone from the dark-toned layer; exact matching in colour or brightness or shade of colour, and so forth, is not required in order to reduce the manifestation of the contrast.

In an embodiment, the light-toned and dark-toned layers are each formed of nylon and spandex. In other embodiments, the light-toned and dark-toned layers are each formed of one or more elastic materials such as appropriate combinations of nylon, cotton, polyester, elastane, spandex, bamboo, Lycra™, and merino wool.

Surprisingly, it has been discovered that incorporating a breast pad having a dark-toned surface into a two-toned upper body garment such as a bra such that the dark-toned surface is adjacent to the light-toned layer of the garment can reduce or eliminate the headlight (contrast) effect that would otherwise manifest itself were a light-toned breast pad to be adjacent to the light-toned layer of the garment, when the light-toned layer of the garment is facing outwards from the wearer.

Without wishing to be bound to a particular theory, it is believed that the improvement is a result of the breast pad having a tone (ie. brightness or lightness value) that is substantially similar to or matches the tone of the dark-toned side of the reversible garment, which despite being behind the light-toned layer can become very slightly perceptible through the slightly-thinned light-toned layer when the garment is worn and thereby stretched around the wearer. For example, when the garment is worn, the material of the outward-facing side will resiliently stretch somewhat to receive and then conform to the wearer. While the material is stretched it slightly thins, resulting in less occlusion of the breast pad and the darker-toned layer by the lighter-toned layer that is facing outwards from the wearer. A breast pad having a tone that is substantially similar in tone to, or is matched to the tone of, the dark-toned layer will manifest as more blended, thereby reducing or eliminating the contrast as compared to using a light-toned breast pad under the same conditions.

BRIEF DESCRIPTION OF DRAWINGS

Embodiments of the invention will now be described with reference to the appended drawings in which.

DETAILED DESCRIPTION OF EMBODIMENTS

The present invention provides a reduced or eliminated contrast or "headlight" effect that tends to manifest in the prior art when the light-toned layer of a two-toned reversible upper body garment such as a bra incorporating a light-toned breast pad is facing outwards from the wearer while the dark-toned layer was adjacent the wearer. This is done by including one or more dark-toned breast pads, or at least one or more breast pads that have a dark-toned surface that is adjacent to the light-toned layer. The dark-toned surface of the one or more breast pads faces outwards from behind the light-toned layer when the light-toned layer is facing outwards from the wearer.

It is expected that this reduction of the headlight effect using such dark-toned surface of a breast pad would occur with garments made from various kinds of materials and constructions, in particular those in which the outward-facing layer stretches to a sufficient degree when worn that the darker tone of the underlying layer begins to manifest itself through the outward-facing layer enough that would have caused an observer to visually register its contrast with a lighter-toned breast pad. Using the darker tone for the breast pad reduces the likelihood that the observer could visually register such a contrast.

Figure 1:
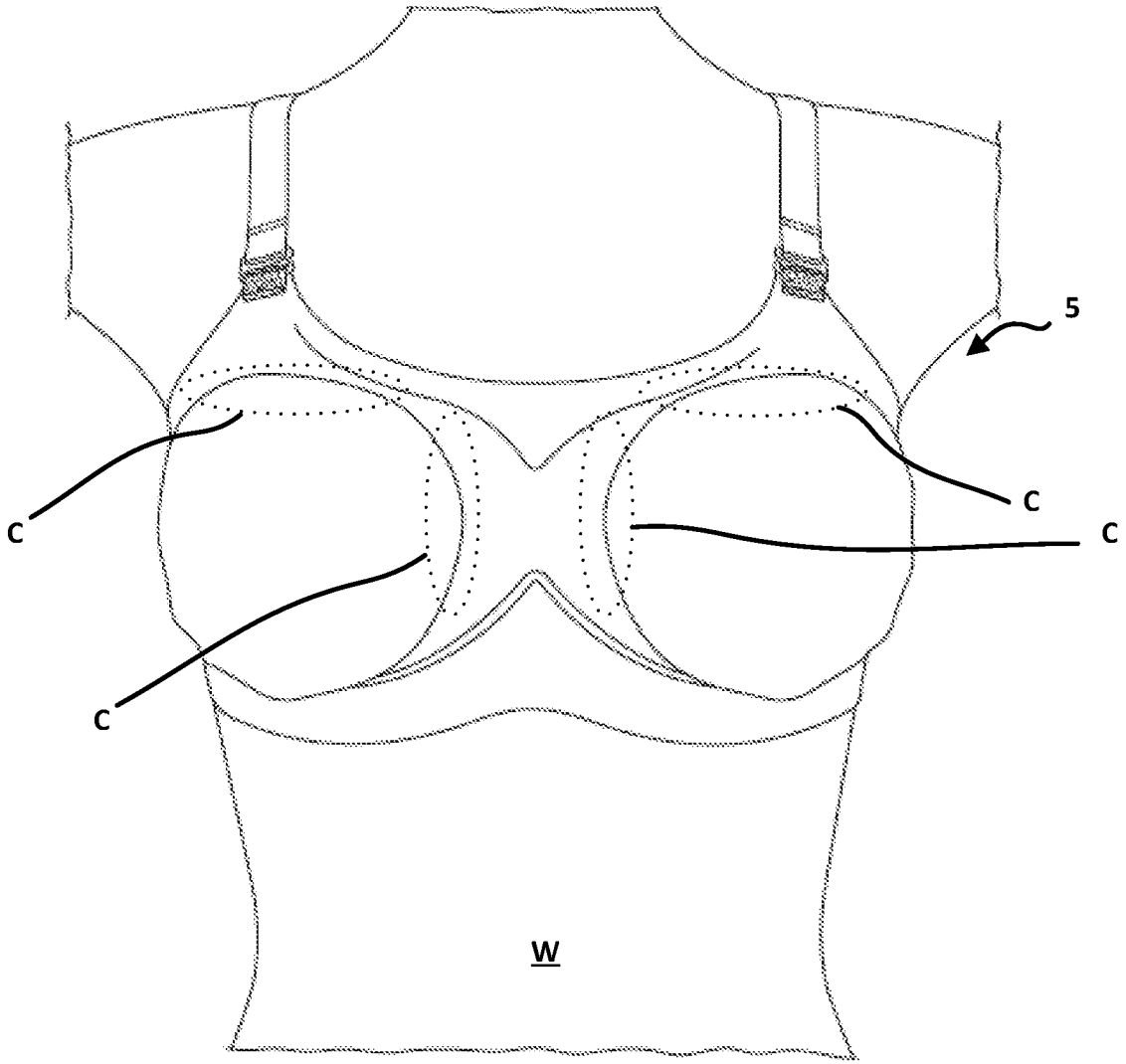
Fig. 1 (Prior Art)
FIG. 1 is a front elevation view of a prior art bra having a nude (i.e. light-toned) breast pad arranged between an outward-facing light-toned layer and an inner dark-toned layer, demonstrating the "headlight" effect.

FIG. 1 is a front elevation view of a prior art reversible bra 5 being worn with its light-toned layer facing outward from the wearer W. The prior art bra has a nude (i.e. light-toned) breast pad arranged between the outward-facing nude (i.e. light-toned) layer and an inner black (i.e. dark-toned) layer. There is a contrast between the light-toned layer and the dark-toned layer that is visually noticeable, and thus particularly susceptible to the headlight effect. The "headlight" effect can be observed and is due to the contrast manifesting itself at various locations, some of which are denoted with the letter C, at the edge of the light-toned breast pad where it contrasts with the inner dark-toned layer when at least the light-toned layer is thinned slightly upon being stretched around the upper body of the wearer for normal wearing. This contrast is not as immediately apparent when the bra is not stretched around the upper body of the wearer because the light-toned layer is not as thinned when it is not as stretched, but yet it manifests itself despite the outward facing layer being a smooth, single-toned layer.

Figure 2:
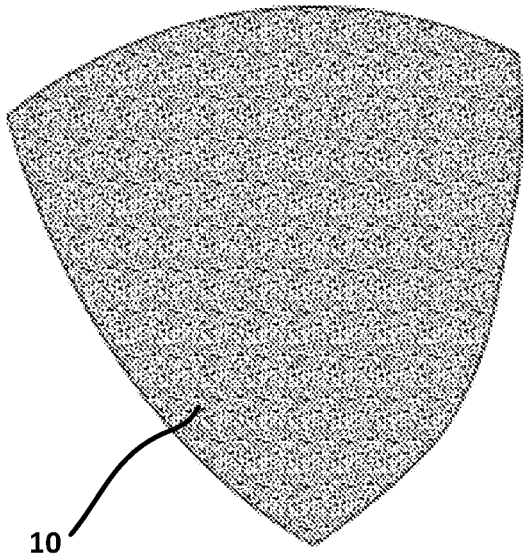
FIG. 2 shows a dark-toned breast pad, in this embodiment a black semilunar breast pad, seen from the surface intended to face towards the wearer.
Figure 3:
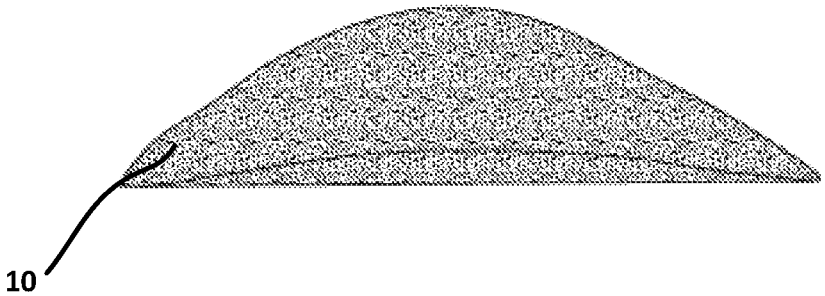
FIG. 3 shows a dark-toned breast pad, in this embodiment a black semilunar breast pad, seen from the surface intended to face away from the wearer.

FIG. 2 shows a dark-toned breast pad 10, in this embodiment a black semilunar breast pad, seen from one of its dark-toned surfaces. The breast pad 10 can be easily flexed to be concave or convex from the perspective shown in order to be reversible along with the bra within which it is held, and in FIG. 2 is shown in a concave configuration that would be appropriate for facing towards the wearer. FIG. 3 shows the dark-toned breast pad 10 in a convex configuration that would be appropriate for facing away from the wearer.

Figure 4A:
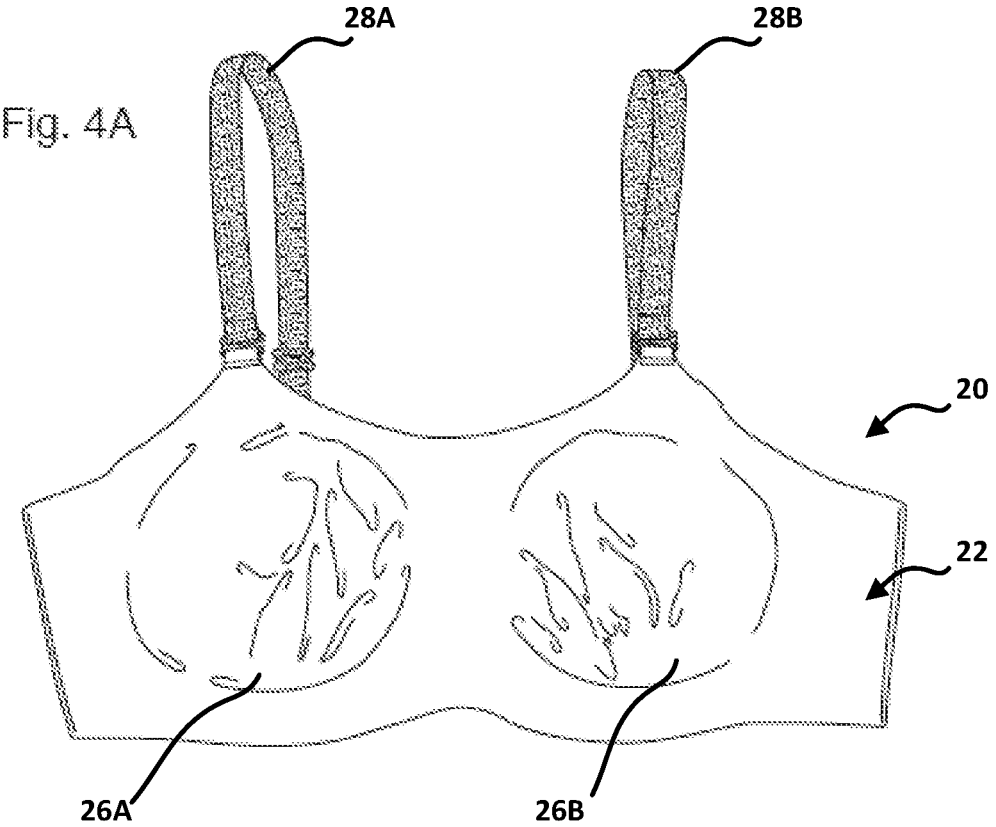
FIGS. 4A and 4B are elevation front views from two sides of an upper body support garment, in this embodiment a reversible wireless bra.
Figure 4B:
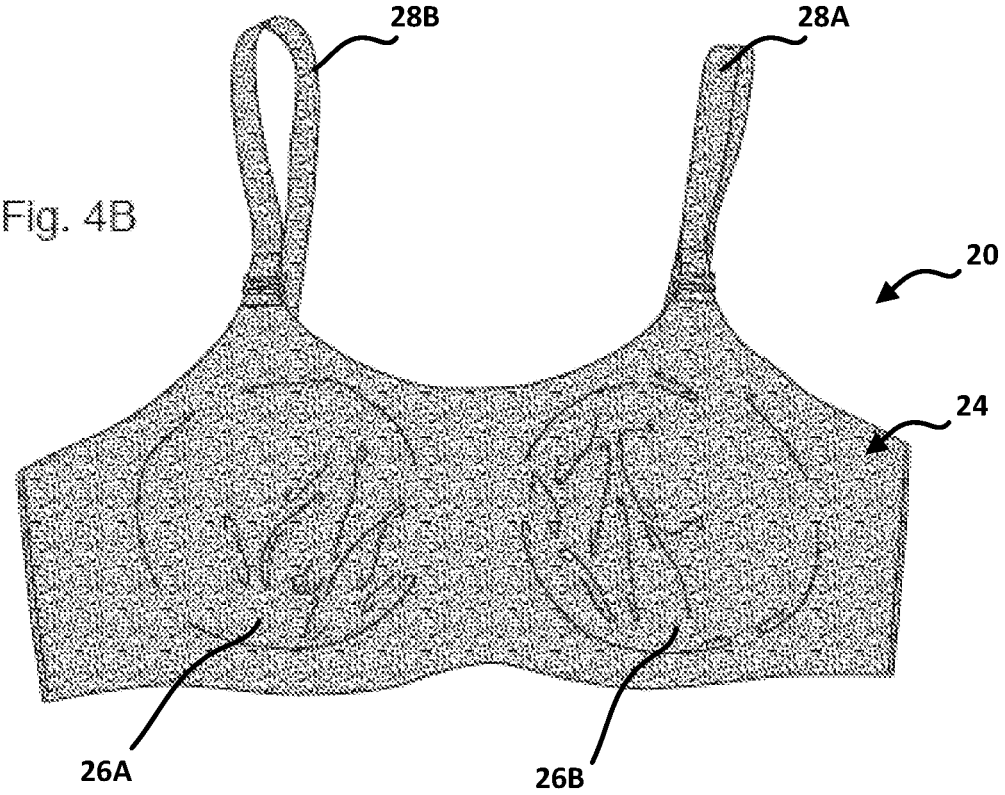

FIGS. 4A and 4B are elevation front views from two sides of an upper body support garment 20, in this embodiment a reversible wireless bra. Bra 20 includes a light-toned layer 22 seamlessly bonded to a dark-toned layer 24. In this embodiment, the light-toned layer 22 is a nude tone and the dark-toned layer 24 is a black tone. In this embodiment, the layers 22 and 24 are each formed of nylon and spandex, and overlie each other in a mirror image. Two dark-toned breast pads 10 are positioned between the light-toned layer 22 and the dark-toned layer 24 in respective breast pad pockets 26A and 26B. In this embodiment, each domed dark-toned breast pad 10 is formed of a flexible but resilient foam-based material that can be selectively pushed inside-out thereby to be either convex or concave in relation to any of the layers 22 or 24 depending upon the orientation of the bra 20 with respect to the wearer W. That is, to receive the breast of a wearer W from either side and to be domed and support the breast once received. In this embodiment, two removable bra straps 28A, 28B are also shown, which each are operable to hook onto corresponding loops thereby to provide support and hold the bra 20 into place on the wearer. In this embodiment, the removable bra, straps 28A and 28B can have their own light-toned and dark-toned sides and can be worn with respect to the rest of bra 20 in various configurations.

Figure 5A:
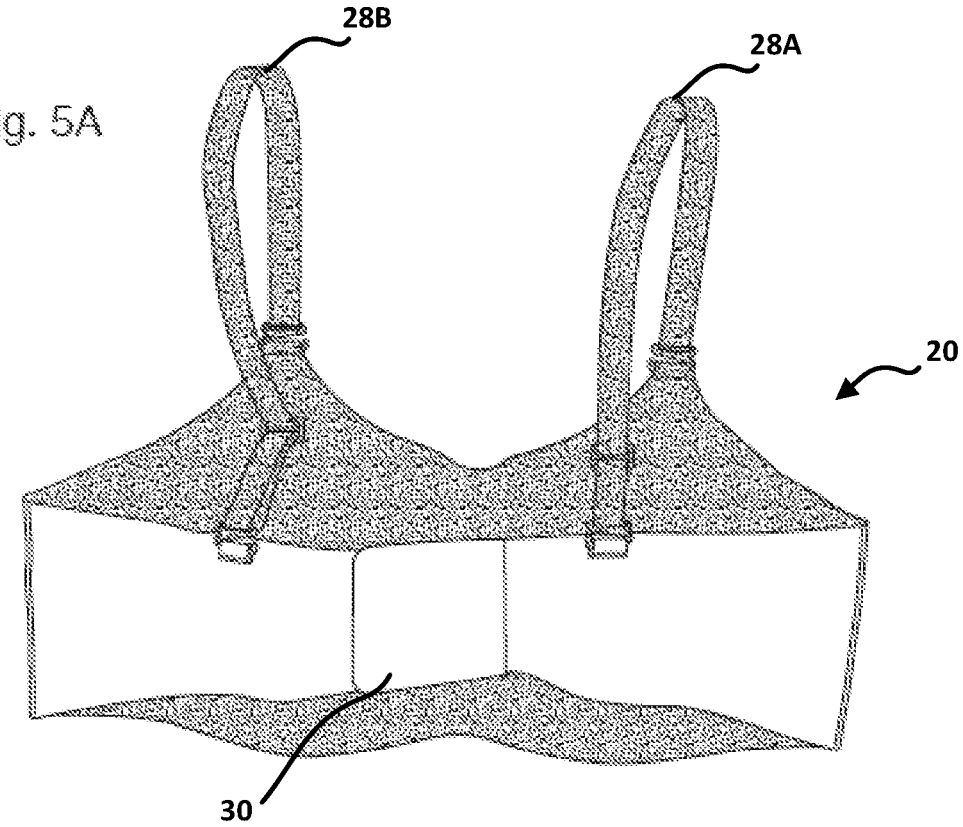
FIG. 5A is an elevation back view of bra oriented such that the light-toned layer is to face outward from the wearer.
Figure 5B:
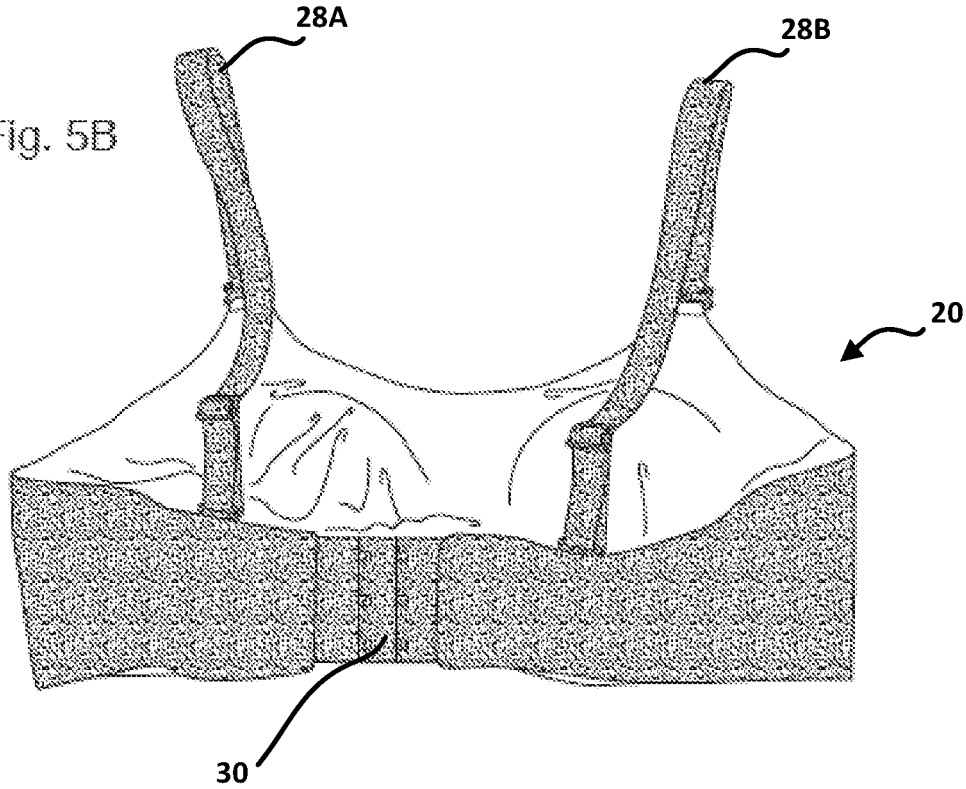
FIG. 5B is an elevation back view of a bra when reversed from the state shown in FIG. 5A, such that the dark-toned layer is to face outwardly from the wearer.

FIG. 5A is an elevation back view of bra 20 when bra 20 is oriented such that the light-toned layer 22 is to face outward from the wearer of bra 20. FIG. 5B is an elevation back view of bra 20 when bra 20 is reversed from the state shown in FIG. 5A, such that the dark-toned layer 24 is to face outward from the wearer of bra 20. As shown in both FIGS. 5A and 5B, the back of bra 20 includes a hook fastening mechanism 30 which holds the garment in place once it has been stretched around the upper body of the wearer.

Figure 6:
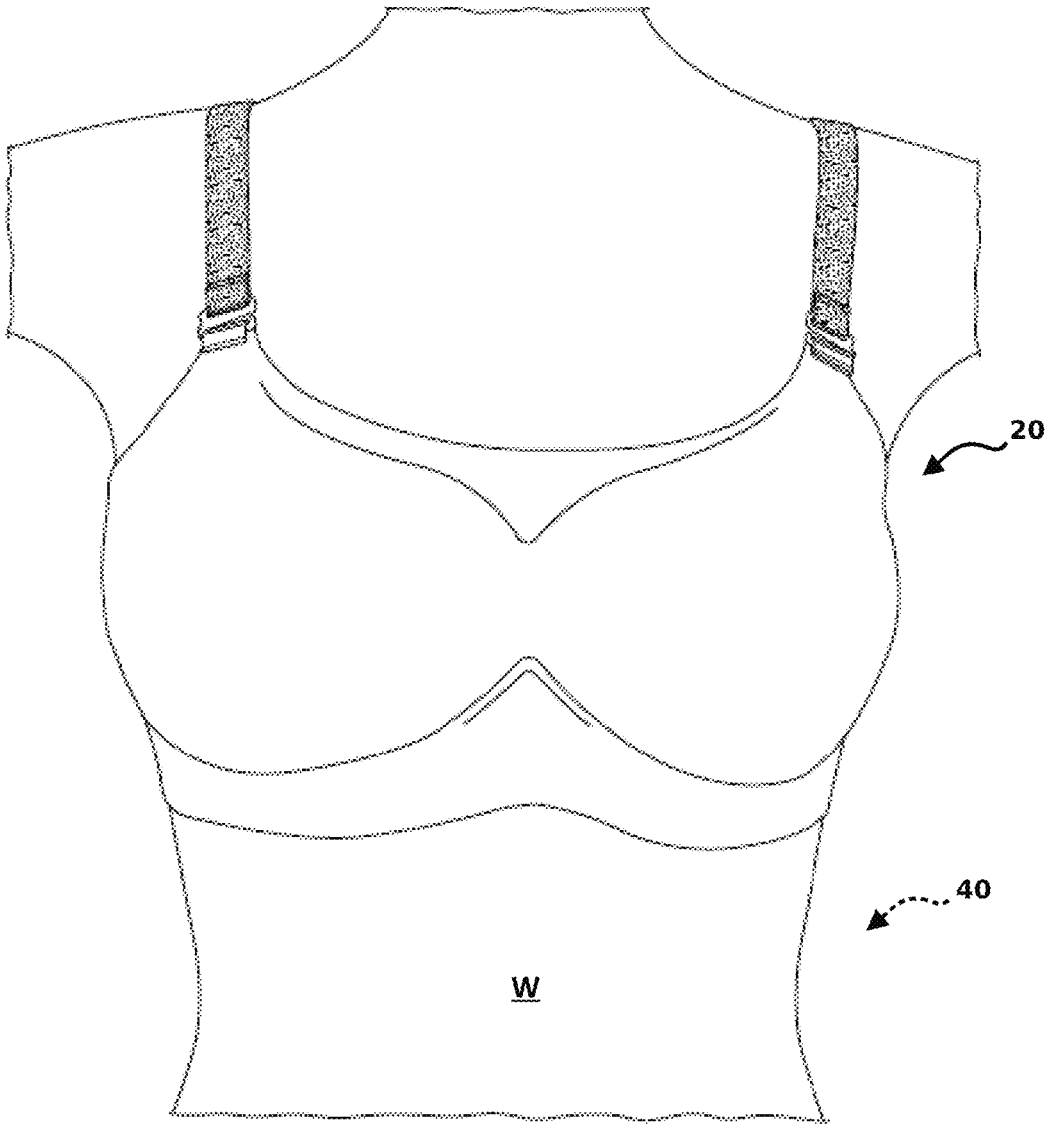
FIG. 6 is a front elevation view of a bra according to the invention having a black (i.e. dark-toned) breast pad arranged between an outward-facing light-toned layer and an inner dark-toned layer, demonstrating a significant and beneficial reduction in contrast as compared to the configuration of FIG. 1.

FIG. 6 is a front elevation view of a wearer W wearing bra 20 having a black (i.e. dark-toned) breast pad 10 arranged between an outward-facing light-toned layer 22 and an inward-facing dark-toned layer 24, demonstrating a significant and beneficial reduction in or elimination of contrast as compared to the high-contrast configuration of FIG. 1. The reduction in contrast provides a significantly smoother, more uniform and therefore generally more aesthetically-desirable appearance for the overall garment.

While in the embodiments described the garment is equipped with a hook-fastening mechanism 30 that allows fastening of the garment equally irrespective of whether the garment is worn on the first or second position, in another embodiment the garment is formed as permanent loop not requiring a back-fastening mechanism but instead being reversibly wearable by, for example, simply pulling the garment down over the head and upper body of the wearer W. For example, a pull over bra or another garment such as a padded exercise top, a dress, a padded one-piece swimsuit or a bikini swimsuit.

While in the embodiment described the bra straps are removable, in alternative embodiments the bra straps are more permanently affixed to the rest of the bra such as by being stitched to the bra.

While an embodiment has been described in which the dark-toned and light-toned layers being made of nylon and spandex, alternatives are possible in which such layers are made of other generally universally stretchable, absorbent and/or wicking materials.

While an embodiment has been described in which the breast pads are permanently retained between the light-toned and dark-toned layers, in an alternative embodiment, the dark-toned breast pads are removable.

While an embodiment has been described in which there are two breast pads, alternatives are contemplated in which there is a single breast pad.

While embodiments described pertain to a bra, many of the principles herein may be applied to other garments having breast pads, such as for example padded exercise tops, dresses, and padded one-piece and bikini swimsuits. In such examples, and as illustrated in FIG. 6, the garment may be described as including upper body support garment 20 having breast pads as disclosed herein, optionally in combination with a lower torso portion 40 that extends below upper-body support garment 20. Other types of garments and/or upper-body support garments may incorporate the features described herein.

While embodiments described have a black or dark-nude coloured dark-tone layer, alternatives are possible, such as for example dark-tone layers having for example a purple, blue, pink, green, grey, or other colour.

While embodiments described have a white or light-nude coloured light-tone layer, alternatives are possible, such as for example light-tone layers having for example a purple, blue, pink, green, grey, or other colour.

What is claimed is:

1. A reversible upper-body support garment comprising:

a light-toned layer;

a dark-toned layer;

the layers overlying each other and dimensioned to together be stretched in a supporting fit around an upper body of a wearer and reversible with either the light-toned layer or the dark-toned layer facing outwards from the wearer; and at least one breast pad positioned between the light-toned layer and the dark-toned layer, the at least one breast pad having a dark-toned surface that is adjacent to the light-toned layer thereby to face outwards from behind the light-toned layer when the light-toned layer is facing outwards from the wearer.

2. The reversible upper-body support garment of claim 1, wherein the reversible upper-body support garment is incorporated into a garment that is selected from the group consisting of: a bra, an exercise top, a dress, a one-piece bathing suit, and a bikini swimsuit.

3. The reversible upper-body support garment of claim 1, wherein the light-toned layer has a color that is selected from the group consisting of: white, light nude, purple, blue, pink, green, and grey.

4. The reversible upper-body support garment of claim 1, wherein the dark-toned layer has a color that is selected from the group consisting of black, dark nude, purple, blue, pink, green, and grey.

5. The reversible upper-body support garment of claim 1, wherein the dark-toned surface of the at least one breast pad matches the color of the dark-toned layer.

6. The reversible upper-body support garment of claim 1, wherein the dark-toned surface of the at least one breast pad differs in color from the color of the dark-toned layer.

7. The reversible upper-body support garment of claim 1, wherein the light-toned layer and the dark-toned layer are each formed of nylon and spandex.

8. The reversible upper-body support garment of claim 1, wherein the light-toned layer and the dark-toned layer are each formed of one or more of: nylon, cotton, polyester, elastane, spandex, bamboo and merino wool.

9. The reversible upper-body support garment of claim 1, wherein the at least one breast pad is permanently retained between the light-toned layer and the dark-toned layer.

10. The reversible upper-body support garment of claim 1, wherein the shapes of the light-toned layer and the dark-toned layer are mirror images of each other.

11. The reversible upper-body support garment of claim 1, wherein the light-toned layer and the dark-toned layer are seamlessly bonded to each other.

12. The reversible upper-body support garment of claim 1, wherein the dark-toned surface of the at least one breast pad is matched in tone to the dark-toned layer.

13. The reversible upper-body support garment of claim 1, wherein the at least one breast pad is removably positioned between the light-toned layer and the dark-toned layer.

14. The reversible upper-body support garment of claim 1, wherein the reversible upper-body support garment is a bra.

* * * * *